US012672688B2

(12) United States Patent
Robbins et al.

(10) Patent No.: US 12,672,688 B2
(45) Date of Patent: Jul. 7, 2026

(54) HELMET FIT SYSTEM AND METHODS

(71) Applicant: Smith Sport Optics, Inc., Portland, OR (US)

(72) Inventors: Craig Robbins, Portland, OR (US); Eric Thorsell, Portland, OR (US); Aaron Barker, Portland, OR (US)

(73) Assignee: Smith Sport Optics, Inc., Portland, OR (US)

( * ) Notice: Subject to any disclaimer, the term of this patent is extended or adjusted under 35 U.S.C. 154(b) by 0 days.

(21) Appl. No.: 18/065,536

(22) Filed: Dec. 13, 2022

(65) Prior Publication Data

US 2023/0180878 A1 Jun. 15, 2023

Related U.S. Application Data

(60) Provisional application No. 63/289,590, filed on Dec. 14, 2021.

(51) Int. Cl.
*A42B 3/14* (2006.01)
*A42B 3/08* (2006.01)

(52) U.S. Cl.
CPC ..... *A42B 3/145* (2013.01); *A42B 3/085* (2013.01)

(58) Field of Classification Search
CPC ..... A42B 3/145; A42B 3/147; A42B 3/14; A42B 3/324; A42B 3/142; A42B 3/085; A42B 3/125; A43C 11/165
See application file for complete search history.

(56) References Cited

U.S. PATENT DOCUMENTS

| | | | | |
|---|---|---|---|---|
| 9,179,729 | B2 | 11/2015 | Cotterman et al. | |
| 10,588,374 | B2 | 3/2020 | Maloney | |
| 2012/0004587 | A1* | 1/2012 | Nickel | A61F 5/028 602/5 |
| 2013/0239303 | A1 | 9/2013 | Converse et al. | |

(Continued)

FOREIGN PATENT DOCUMENTS

| | | | |
|---|---|---|---|
| DE | 202016100235 | U1 | 4/2017 |
| EP | 2874512 | A1 | 5/2015 |

OTHER PUBLICATIONS

Definition of "cable". Merriam Webster online dictionary. Accessed Jun. 26, 2024 from https://www.merriam-webster.com/dictionary/cable (Year: 2024).*

(Continued)

*Primary Examiner* — Patrick J. Lynch
*Assistant Examiner* — Brianna T. Duckworth
(74) *Attorney, Agent, or Firm* — Dorsey & Whitney LLP

(57) ABSTRACT

A fit adjustment system for a helmet is described. An example fit adjustment system includes a first flexible layer and a second flexible layer joined to the first flexible layer to form a two-layer structure. A lower portion extends below a bottom edge of the helmet when the helmet is worn, and the two-layer structure is sufficiently flexible for repeated folding into the helmet's cavity when not worn. A dial housing is fixed between the first and second flexible layers and includes a dial seat which is exposed through a dial opening in the first flexible layer. A lace-tightening system operatively associated with the dial housing and includes a dial and at least one lace engaged with the dial. The lace is routed through left and right lace guides protruding through the first flexible layer.

34 Claims, 4 Drawing Sheets

(56) References Cited

U.S. PATENT DOCUMENTS

| | | | | |
|---|---|---|---|---|
| 2015/0305429 | A1* | 10/2015 | Javorek | A42B 3/145 2/421 |
| 2016/0255897 | A1* | 9/2016 | Johnson | A61F 13/622 |
| 2017/0006951 | A1 | 1/2017 | Venturini et al. | |
| 2017/0055623 | A1 | 3/2017 | Pritz | |
| 2017/0273390 | A1 | 9/2017 | Maloney | |
| 2018/0325203 | A1 | 11/2018 | Cotterman | |
| 2020/0109920 | A1* | 4/2020 | Banducci | F41H 1/04 |
| 2020/0390182 | A1* | 12/2020 | Huh | A42B 3/142 |
| 2025/0380762 | A1* | 12/2025 | Benoit | A42B 3/085 |

OTHER PUBLICATIONS

Professional Plastics, "Lexan® Polycarbonate, Unfilled, Machine Grade, Extruded". Archived Sep. 5, 2011. Accessed from https://web.archive.org/web/20110905001910/https://www.professionalplastics.com/professionalplastics/MachineGradePolycarbonate DataSheet.pdf (Year: 2011).*

Rivkind, Ron. "Shore Hardness of Flexible 3D Printing Materials". Published Sep. 23, 2014. Accessed from https://filaments.ca/blogs/3d-printing/15475957-shore-hardness-of-flexible-3d-printing-materials (Year: 2014).*

Extended European Search Report dated Apr. 26, 2023 for EP Application No. 22213409.0.

* cited by examiner

HELMET FIT SYSTEM AND METHODS

CROSS-REFERENCE TO RELATED APPLICATION

This application claims the filing benefit of U.S. Provisional Application No. 63/289,590, filed Dec. 14, 2021. This application is incorporated by reference herein in its entirety and for all purposes.

FIELD

The present disclosure relates generally to a helmet fits system and methods for manufacturing the same.

BACKGROUND

Helmets are used to protect the user's head in various activities, for example when participating in sporting or leisure activities such as biking (e.g., road, downhill, motocross, etc.) and snow sports (e.g., skiing, snowboarding, etc.). User's heads vary in sizes and shapes and various fit adjustment systems (or simply fit systems) have been developed to enhance the fit and safety of helmets. However, such existing helmet fit systems may have shortcoming, and thus improvements thereto may thus be desirable.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

The description herein will be more fully understood with reference to these figures in which components may not be drawn to scale, and which are presented as various embodiments of the present invention and should not be construed as a complete depiction of the scope of the present disclosure.

DETAILED DESCRIPTION

Figure 1:
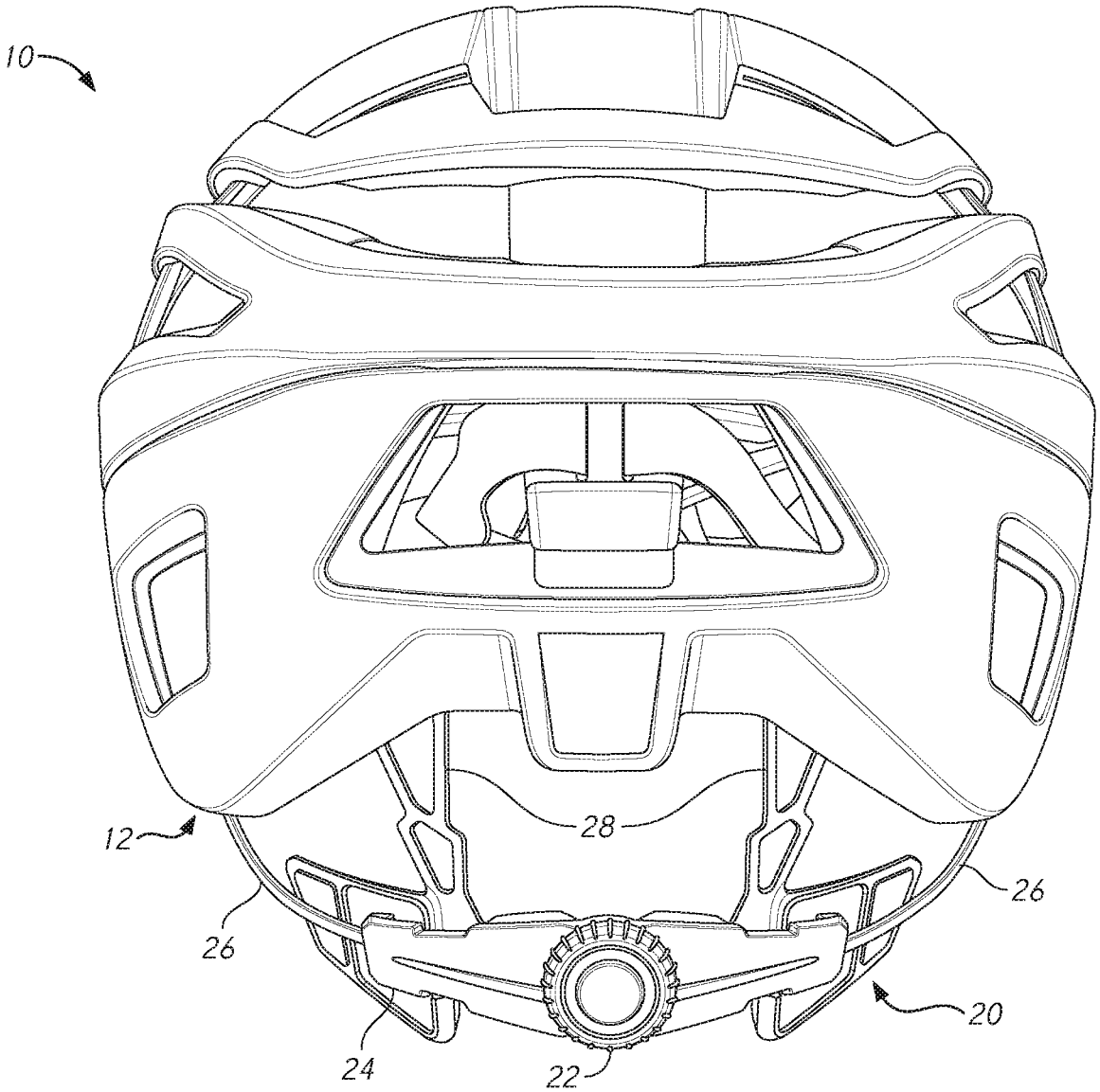
FIG. 1 (Prior Art)
FIG. 1 shows a rear view of an existing helmet with a known fit adjustment system.

A fit adjustment system incorporated into a helmet is shown in FIG. 1. Shown in FIG. 1 is a bike helmet 10 with a fit adjustment system 20, including a dial 22. The dial 22 is rotatably received in a substantially rigid structure 24, which when worn is positioned at the back of the user's head. The structure 24 is operatively associated with a set of lateral and vertical links 26 and 28, respectively, extending from the structure 24 to the helmet 10, and which position and secure the structure 24 and dial 22 at the nape of the user's head when worn. The dial 22, when turned by the user, operates to increase or decrease the distance between the lateral links 26, and optionally adjust the relative position of the vertical links 28, thereby adjusting dimension(s) of the internal bowl-shaped cavity of the helmet and thus the fit of the helmet. While fit systems like the one illustrated in FIG. 1 generally enhance the helmet's fit and thus user safety, a shortcoming of the fit system shown in FIG. 1 is that the fit system (e.g., the structure 24, and the links 26 and 28) extends below the bottom edge 12 of the helmet 10. The links 26 and 28 are often made of thin rigid plastic, creating the risk of damaging the fit system (e.g., bending or breaking the links 26 and 28). Also, because the fit system 20 hangs, often a significant distance, below the edge 12 of the helmet, the fit system 20 increases the form factor of the helmet making carrying and storage of the helmet 10, when not in use, cumbersome. The helmet 10 shown in FIG. 1 includes the VAPORFIT system (provided by SMITH), however the examples herein are equally applicable to fit adjustment systems using other dials, such as the BOA dial fit system (provided by Boa Technology). Embodiments according to the present disclosure may be used to replace certain components (e.g., the rigid structure 24 and/or links 26, 28) of existing fit adjustment systems which may enhance the user experience.

The present disclosure describes a helmet fit system which may address one or more of the shortcomings of existing helmet fit systems. For example, embodiments of the helmet fit system disclosed herein may improve comfort, stowability and increase the flexibly of use of the helmet, for example enabling of the helmet over a variety of soft goods worn by a user. In accordance with examples of the present disclosure, a helmet fit system is implemented, in part, by a flexible member or yoke. The flexible member may have a single layer or multilayer construction (e.g., two layer construction). For example, in a multilayer construction, the flexible member may include a first (or outer) flexible layer and a second (or inner) flexible layer which may be substantially coextensive in some embodiments. The flexible member has an upper portion which is configured for coupling the flexible member to the helmet, typically in a manner not intended for removal by the end user such that a lower portion of the flexible member hangs below the lower edge of the helmet when the helmet is worn. The upper portion of the flexible member is sufficiently flexible to enable the flexible member to be folded into the helmet when not worn. In some embodiments, a second layer is provided along at least the lower portion of the flexible member. In some embodiments, the two-layer construction spans only the lower portion of the yoke and the second layer may be provided only along the lower portion for securing (e.g., sandwiching) the dial housing between the two layers. In some embodiments, the dial housing is attached to a single layer flexible member that is sufficiently flexible to enable the flexible member to be folded into the helmet when not worn. In some embodiments, a liner material may additionally be provided along in inner surface of the flexible member (i.e. the surface that contacts the user's head when the helmet is worn) to enhance the user's comfort.

The flexible member carries an elongate member or housing sandwiched between its two layers. The elongate member includes a dial seat or housing for rotatably coupling a dial of a lace tightening system (e.g., a BOA lace system). When tightened, the lace tightening system increases tension of laces that are attached to the helmet to draw the flexible member more snugly to the user's head. The laces may be made of different materials and have different flexibility. In some embodiments, the laces are wires or strings that extend from the elongate member (e.g., dial) and attach to the helmet. In some embodiments, the laces are flexible, elongated members (e.g., arms) that extend from the elongate member (e.g., dial) and attach to the helmet. The elongate member also includes a pair of arms (or wings) integrally formed with the housing and extending in generally opposite directions from the dial. The wings include lace guides for routing the laces from the dial and towards the periphery of the helmet. While the dial housing here is shown as an elongate member or structure with integrally formed wings, in other embodiments, the central and lateral portions of the dial housing may not be integrally formed. In some embodiments, they may be separately formed and then joined together before being secured to the flexible member, or they may be installed to the flexible member without being joined into a single component. In some embodiments, one or more hinges (e.g., an integral or living hinge as may be formed by thinned or weakened portion of material between the two hinged portions) may be included between the dial housing and the lace guides so as to enable folding along multiple directions. The resulting fit adjustment system provides a substantially rigid lower portion that hangs below the helmet and supports the dial-based lace tightening system, and a flexible upper portion attaching the yoke to the helmet and enabling the fit adjustment system (e.g., at least the lower portion of the yoke) to be folded into the bowl-shaped cavity of the helmet when not in use. FIGS. 2A-2D show views of an example helmet fit system and components thereof in accordance with the present disclosure.

According to some embodiments, a fit adjustment system 100 includes a flexible member (which may also referred to as yoke) 200. The flexible member 200 supports (or carries) a dial-based lace-tightening mechanism or assembly 300. The term flexible when describing the flexible member 200 implies that the member may be bendable such that it can be folded (e.g., into and out of the page) anywhere along its upper portion 202, such as along any arbitrary location below the attachment location 205 (e.g., along the arbitrary fold line 209 shown only for illustration purposes) without permanently deforming the yoke 200.

Figure 2A:
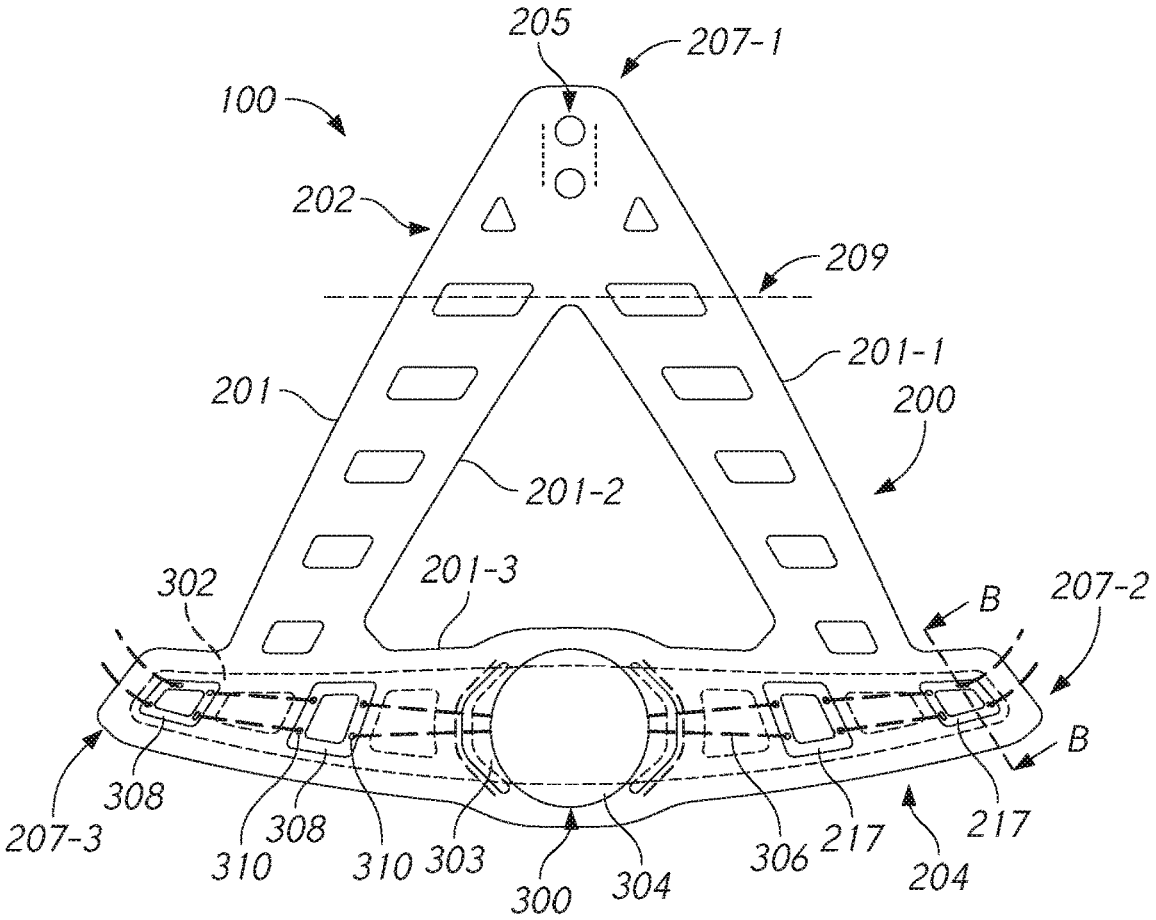
FIG. 2A shows a front view of an example fit adjustment system according to some embodiments of the present disclosure.
Figure 2B:
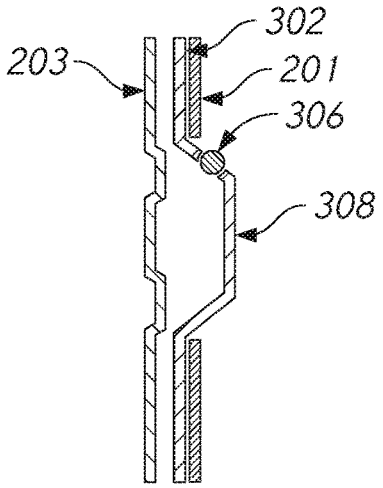
FIG. 2B shows a section view of the fit adjustment system of FIG. 2A taken at line b-b.
Figure 2C:
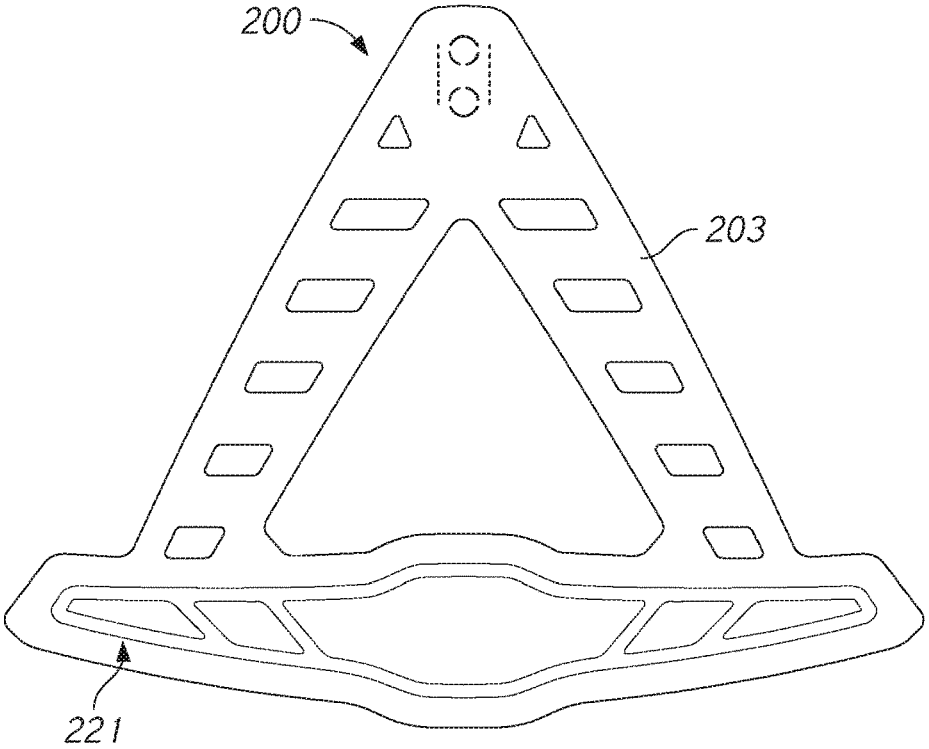
FIG. 2C shows a rear view of the fit adjustment system of FIG. 2A.
Figure 2D:
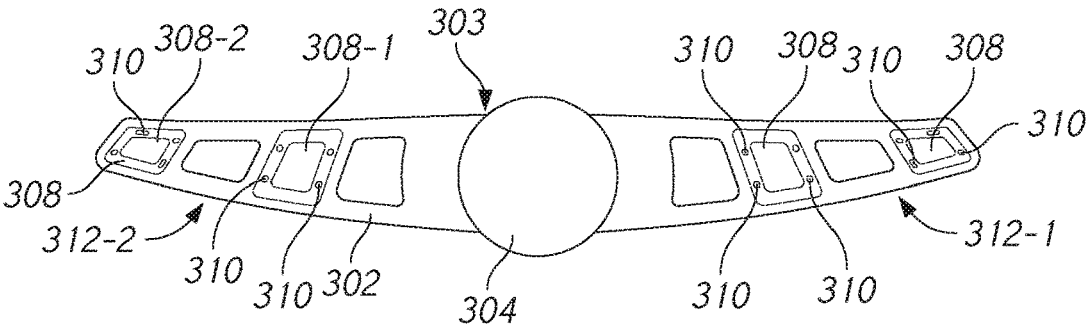
FIG. 2D shows an integral dial housing as may be used in the fit adjustment system of FIG. 2A.

The flexible member 200 may be implemented in some embodiments by a first (upper or outer) layer 201 and a second layer 203 (See FIGS. 2B and 2C). In use (i.e. when the helmet is worn) the first layer 201 faces outward (or away from the head of the user) and may thus also be referred to as upper (or outer) layer 201. The second layer 203, when worn, faces inward, towards the user's head and may thus also be referred to as lower (or inner) layer 203. Each of the layers 201 and 203 is made from a flexible material. One or both of the layers 201 and 203 may be implemented as thin film layers. In some embodiments, two different materials are used for the first and second layers 201 and 203. For example, the outer layer 201 may be made from a thermoplastic elastomer (e.g., thermoplastic polyurethane (TPU)). In some embodiments, the outer layer 201 is a thin film of TPU which may be opaque and have a thickness ranging from about 1 mm to about 1.5 mm, in some cases thicker. In some embodiments, the thickness of at least one of the first and second layers may not exceed about 3 mm. In some embodiments, the thickness of the two layer structure formed by the first and second layers joined together may not exceed about 3 mm. Preferably, the two layer structure may not exceed 2 mm, or more preferably its thickness may be up to about 1.5 mm. In some embodiments, the thickness of a layer made from an elastomer such as TPU may be at least 0.15 mm, or preferably at least 0.25 mm and may not exceed 1 mm. In one specific embodiment, two TPU layers of about 0.5 mm each were joined together to form a two-layer structure not exceeding about 1 mm. In other embodiments, the layer 201 is formed of a different suitable flexible material, e.g., a different type of elastomer. The inner layer 203 may be made from any suitable, durable fabric, such as micro-suede.

The flexible member may be implemented in some embodiments by a single layer. The layer is made from a flexible material, and may be implemented as a thin film layer. In some embodiments, the layer may be made from a thermoplastic elastomer (e.g., thermoplastic polyurethane (TPU)). In some embodiments, the layer is a thin film of TPU which may be opaque and have a thickness ranging from about 1 mm to about 1.5 mm, in some cases thicker. In some embodiments, the thickness of the layer may not exceed about 3 mm. Preferably, the single layer may not exceed 2 mm, or more preferably its thickness may be up to about 1.5 mm. In some embodiments, the thickness of a layer made from an elastomer such as TPU may be at least 0.15 mm, or preferably at least 0.25 mm and may not exceed 1 mm. In some embodiments, the layer is formed of a suitable flexible material, e.g., a type of elastomer. The layer may also be made from any suitable, durable fabric, such as micro-suede.

In some embodiments, the outer layer 201 has a generally triangular shape, defined by first and second oblique segments 201-1 and 201-2 which meet at the upper vertex 207-1, and a transverse (or connecting) segment 201-3 extending between and connecting the two lateral vertices 207-2 and 207-3. One or more cutouts may be provided along the oblique segments to reduce weight, add further flexibility and/or stretch ability, and/or provide ventilation. One or more openings (or windows) 217 may be provided through the thickness of the transverse segment 201-3 such that portion(s) of the elongate member (e.g., dial housing 302) penetrates and is exposed on the outer side of the yoke 200. In some embodiments, the first and second layers 201 and 203 (see also FIG. 2C) have generally the same shape and are thus co-extensive with one another when assembled. In such embodiments, the inner layer 203 also includes a pair of oblique segments and a transverse segment, connected together to define three vertices. The oblique segments of the inner layer may similarly include cutouts corresponding in location and shape to those of the outer layer. Unlike the outer layer 201, inner layer 203 may not include windows along its transverse segment. In some embodiments, the outer and inner layers 201, 203 may be joined, e.g. bonded, along at least a portion of the two layers. For example, in some embodiments, the outer and inner layers 201, 203 are joined with a hot melt adhesive. In some embodiments, the inner layer 203 may be decorated or otherwise treated, for example embossed (e.g., via heat press) with a pattern 221.

In some embodiments, the liner is substantially co-extensive with the interior face of at least the lower portion of the yoke, in some cases with only the lower portion of the yoke. The liner may be a flexible material in some embodiments. The liner may be made from a durable fabric, such as micro-suede, in some embodiments. The liner is irremovably attached (e.g., bonded) thereto. The term irremovably implies that the outer layer is not intended to be removed once the helmet is provided to a user. In other embodiments, the liner may be co-extensive with the entire rear side of the yoke and may be attached, at least along a portion of the rear side of the yoke.

Figure 2E:
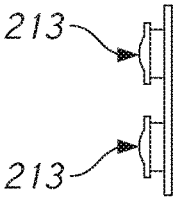
FIGS. 2E and 2F show an attachment member according to a embodiment of the disclosure.
Figure 2F:
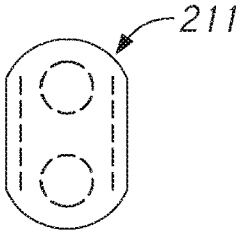

FIGS. 2E and 2F illustrate an attachment member according to an embodiment of the disclosure. The flexible member (or yoke) 200 may be suspended via an attachment member 211 from the helmet 10 such that it hangs below the bottom edge 12 of the helmet 10. The attachment member 211 may be implemented by one or more buttons (or rivets) 213, which may be integrally formed with one of the layers 201 or 203, or may be otherwise fixedly attached thereto. In the illustrated embodiment, the yoke 200 is attached to (e.g., suspended from) the helmet via its upper portion 202, which includes one of the three vertices (e.g., vertex 207-1). The lower portion 204, including the other two vertices 207-2 and 207-3, may hang below the edge 12 of the helmet 10 when assembled thereto. In use, such as when the helmet is worn, the lower portion 204 of the yoke 200 extends below the edge 12. When not in use (i.e., when the helmet is not worn), the yoke 200 is foldable into the helmet's cavity whereby at least the lower portion 204 may be located in the helmet's cavity and not hang from the bottom of the helmet.

The fit adjustment system 100 further includes an elongate member 302. In some embodiments of a flexible member including first and second layers 201 and 203, the elongate member 302 is between the first and second layers 201 and 203. In some embodiments, the elongate member 302 is fixed between the first and second layers 201 and 203. The elongate member 302 may be fixed between the first and second layers 201 and 203 as a result of joining the first and second layers, for example, in some embodiments, as a result of joining the first and second layers (e.g., using hot melt adhesive). In some embodiments of a flexible member including a single layer, the elongate member 302 is attached to the single layer flexible member.

The elongate member 302 is configured to operatively couple the dial 304 of the lace-tightening system 300 to the yoke and to guide the one or more laces 306 toward the periphery of the helmet cavity. The elongate member 302 may be made from a material (e.g., a plastic) which is stiffer (i.e., more rigid) than the flexible yoke 200. For example, the elongate member 302 may be implemented as an integrally formed (or monolithic) nylon body 302. In other embodiments, the body 302 may be made (e.g., injection molded, 3D printed, cast, machined or otherwise suitably formed) from a different non-elastomeric thermoplastic material (e.g., Acrylonitrile Butadiene Styrene (ABS), acrylic, etc.) or another suitable and generally rigid plastic or composite. In some embodiments, the elongate member 302 may be formed two or more different materials, at least a portion thereof being substantially rigid. The elongate member 302 defines a seat (or housing) 303 for the dial 304, such that the dial 304 can be rotatably coupled to the elongate member 302. The elongate member 302 may thus be interchangeably referred to as a dial housing. The elongate member 302 includes a pair of arms (or wings) 312-1 and 312-2 which extend from opposite sides of the seat 303. In some embodiments, the thickness of the nylon body 302 (e.g., the thickness of the wings 312-1 and 312-2 may be range from about 1 mm to about 3 mm, in some embodiments, it may not exceed 2.5 mm. In some embodiments the thickness of the nylon body 302 is up to about 2 mm, or preferably about 1.5 mm. When the elongate member 302 is assembled into the yoke 200, the elongate member 302 is oriented generally along the length of the lower portion 204 (e.g., along the length of the segment 201-3 of the layer 201) and the wings 312-1 and 312-2 extend towards the lateral ends of the yoke (e.g., the vertices 207-2 and 207-3 of the layer 201). The wings 312-1 and 312-2, which are preferably integrally formed with the seat 303, provide a wider area for attaching the dial seat 303 to the yoke. In some embodiments, the wings 312-1 and 312-2 may include portions which are sandwiched between the two layers of the yoke and thus serve to secure the dial housing to the yoke, and may further include portion (e.g., the lace guide protrusions or pods 308), that penetrate the upper layer (e.g., through the windows 217) and are exposed on the outer side of the yoke.

The dial housing 302 is configured to guide the lace along the length of the lower portion 204. The dial housing 302 includes protrusions comprising lace guides (also referred to as lace pods or simply pods) 308, which penetrate the upper layer 201, such that they may be visible on the outer side of the yoke. The lace pods 308 are thus configured to guide the lace along the exterior (i.e. on the outside) of the yoke, which may be advantageous to avoid binding or other interference with the movement of the lace as it is tightened or loosened. In some embodiments, the lace may additionally or alternatively be routed between the two layers 201 and 203 at least along a portion of the yoke. In some embodiments, each lace pod 308 is implemented by a thickened or contoured portion of the elongate member 302, at one or multiple spaced apart locations on opposite sides of the dial seat 303, and which provides at least one passage along its length for the lace. Guide holes 310 which connect the opposite lateral sides of a lace pod 308 may provide the passage through the protrusion for the one or more laces 306. In some embodiments, the lace guides may additionally or alternatively be implemented by hooks, loops, or other suitable structures coupled to the elongate member 302 for routing a lace along a desired path. In the example in FIG. 2D, the seat 303 and thus the dial 304 are generally centrally positioned between the two wings 312-1 and 312-2. In some embodiments, each wing includes at least one, in some cases two or more pods that provide lace guides. For example, each wing may include a first pod 308-1 a fixed distance from the dial 304, and a second pod 308-2 a fixed distance from the first pod in the opposite direction from the dial. The two pods 308-1 and 308-2 may, but need not be equally spaced along the length of the respective wing. In some embodiments, the lateral-most pod of each wing is positioned at the lateral end of the wing. In some embodiments, the pods 308 are symmetrically arranged on the opposite sides of the dial seat 303. In some embodiments, the elongate member 302 may have a length of about (or slightly less than) the length of the lower portion 204 of the yoke (e.g., about 85%, 90% or more), such that the lateral-most pods and corresponding lace guides route the lace to the lateral-most ends of the yoke.

The yoke 200 is attached to the helmet, such as via the attachment member 211 (e.g., by press-fitting the one or more rivets into corresponding one or more openings of the helmet). When attached to the helmet, the yoke 200 becomes suspended by its attachment location. In some embodiments, the attachment location of the yoke is at its vertex 207-1 where the oblique segments 201-1 and 201-2 meet. In this configuration, the lower wider portion of the yoke hangs below the upper narrower portion of the yoke, from the attachment point to a location below the bottom edge 12 of the helmet. When not in use, the flexible yoke 200 may be folded into the helmet cavity such that the yoke is positioned substantially fully within the cavity and does not extend below the edge 12.

Figure 3C:
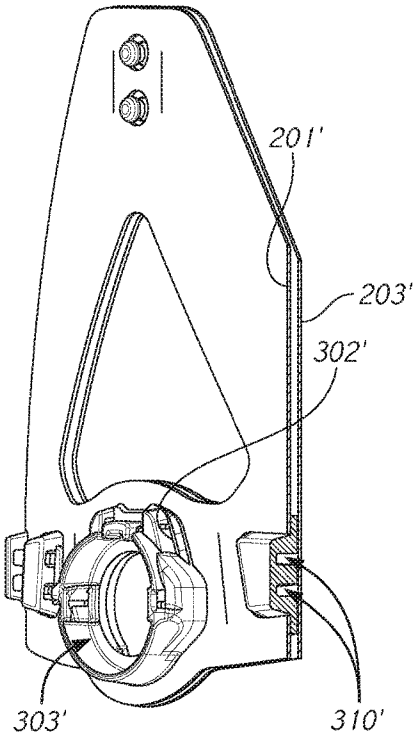
FIGS. 3A-3C shows various views of components of a fit adjustment system according to further embodiments of the present disclosure.
Figure 3A:
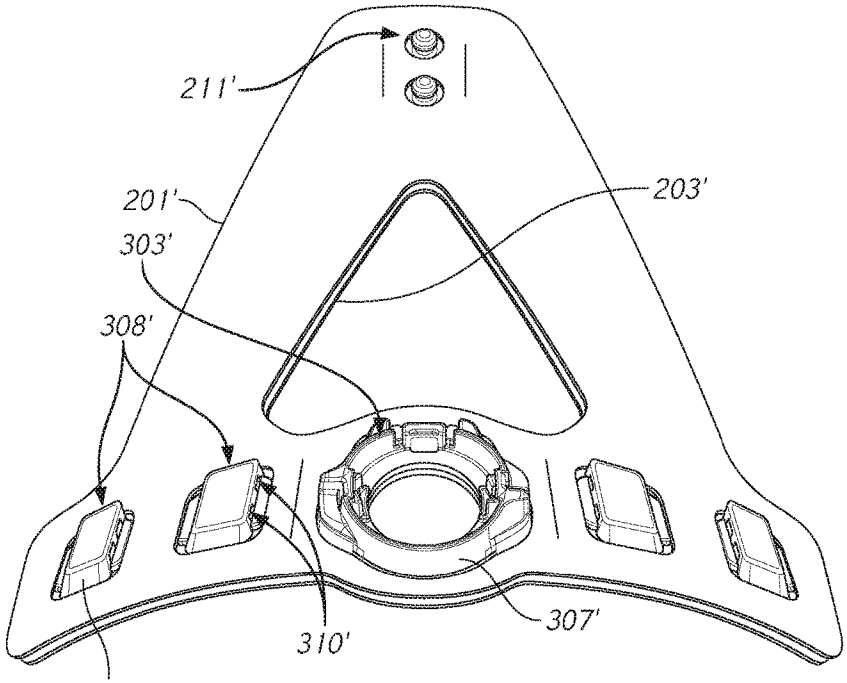
Figure 3B:
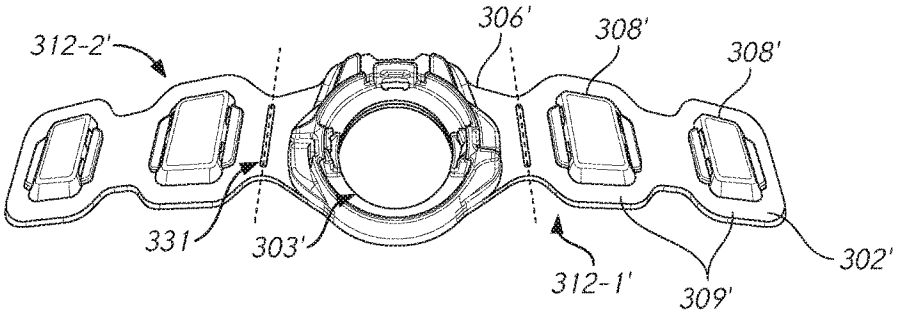

FIGS. 3A-3C shows views of a fit adjustment system, or components thereof, according to further embodiments of the present disclosure. The fit adjustment system 100' is similar to the fit adjustment system 100 in that it similarly includes a yoke 200'. In some embodiments, the yoke 200' includes a single flexible layer, which may be formed of a flexible polymer (e.g., a thin film of a thermoplastic elastomer). In some embodiments, the yoke 200' includes multiple layers (e.g., two flexible layers). For example, the yoke 200' may be comprised of two flexible layers 201' and 203', one of which may be formed of a flexible polymer (e.g., a thin film of a thermoplastic elastomer), and the other may be formed of the same polymer, a different flexible polymer or any suitable durable fabric, including fabrics comprising synthetic or natural fibers. Yoke 200' may similarly be attached to (e.g., suspended from) the helmet via an attachment member 211', which suspends the yoke 200' with its wider portion located below its narrower portion and below the edge of the helmet, when worn. The yoke 200' supports an elongate dial housing 302'. In some single layer embodiments of the yoke 200', the elongate dial housing 302' is attached to the single flexible layer. In some embodiments including two layers, the elongate dial housing 302' is sandwiched between the two layers 201' and 203'. In some embodiments, the elongate dial housing is fixed between the first and second flexible layers 201' and 203'. The elongate dial housing may be fixed between the first and second flexible layers 201' and 203' as a result of joining the first and second flexible layers, for example, in some embodiments, as a result of joining the first and second flexible layers (e.g., using hot melt adhesive).

The elongate dial housing 302' may include a central portion 307' that provides a seat 303' for a dial of a lace tightening system. The seat 303' may be defined by contoured (e.g., protruding) walls 306' that define a substantially circular cavity that accommodates the dial at least partially therein. In other embodiments, the dial seat does not include protruding wall but may be otherwise configured to position the dial, e.g., substantially centrally along the length of the dial housing 302'. The dial housing 302' includes a pair of arms (also referred to as wings) 312-1' and 312-2' extending outward from the dial seat 303'. In this embodiment, the arms extend in substantially diametrically opposite direction from the seat 303'. In other embodiments, the arm may extend in generally opposite direction, from different locations of the dial (e.g., e.g., within a 45 degree range) and may define a generally obtuse angle therebetween. The arms include one or more lace guides, which in some embodiments are provided in by passage(s) 310' defined by lace pods 308'. Each lace pod may be implemented by a structure protruding or extending above the surface of the lands 309' that define the acreage of the arms 312-1' and 312-2'. When assembled to a flexible two-layer structure, the lace guides may protrude through the two-layer structure. In some embodiments, one or more hinges (e.g., an integral hinge 331) may be provided between the portion of the dial housing 302' that defines the seat 303' and the lace pods 308' which include the lace guides. In yet other embodiments, the lace guides may not be integrally formed with the dial seat but may be separately formed and/or separate components after assembly into a two-layer structure. This can add additional flexibility, such as to enable folding also along generally vertical folding lines (i.e. transversely to the generally horizontal folding lines that may facilitate folding of the two-layer structure into the helmet's cavity).

The above specification, examples and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims. The foregoing description has broad application. The discussion of any embodiment is meant only to be explanatory and is not intended to suggest that the scope of the disclosure, including the claims, is limited to these examples. In other words, while illustrative embodiments of the disclosure have been described in detail herein, the inventive concepts may be otherwise variously embodied and employed, and the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

The invention claimed is:

1. A fit adjustment system for a helmet defining a helmet cavity, comprising: a first flexible layer comprising: a lower portion configured to extend below a rear edge of the helmet when the helmet is worn, the lower portion comprising a transverse segment extending between a first lateral vertex and a second lateral vertex, and an upper portion configured to couple the first flexible layer to the helmet, wherein the first flexible layer comprises a first oblique segment and a second oblique segment, wherein the first oblique segment and the second oblique segment meet at an upper vertex in the upper portion, wherein the first oblique segment meets the transverse segment at the first lateral vertex, and wherein the second oblique segment meets the transverse segment at the second lateral vertex; a second flexible layer substantially co-extensive with an interior face of the lower portion of the first flexible layer and fixed to the first flexible layer along at least a portion thereof to form a two layer structure which is sufficiently flexible for repeated folding into the helmet's cavity; and an elongate housing configured to rotatably receive a dial for tightening at least one lace of the helmet, wherein the elongate housing is secured between the first and second flexible layers, wherein the elongate housing comprises a central portion de fining a dial seat, the elongate housing further comprising first and second arms extending in opposite direction from the dial seat, each of the first and second arms comprising at least one lace guide, and wherein at least a portion of the elongate housing coextends with the transverse segment of the first flexible layer.

2. The fit adjustment system of claim 1 wherein at least the first flexible layers is formed of a thermoplastic elastomer.

3. The fit adjustment system of claim 2 wherein both the first flexible layer and the second flexible layer are formed of a thermoplastic elastomer.

4. The fit adjustment system of claim 1 further comprising a flexible liner secured to a side of the second flexible layer opposite the first flexible layer.

5. The fit adjustment system of claim 4, wherein the flexible liner comprises micro-suede material.

6. The fit adjustment system of claim 1, wherein the first flexible layer is formed of a thermoplastic elastomer and the second flexible layer comprises a synthetic or natural fabric material.

7. The fit adjustment system of claim 1, wherein the dial seat and the first and second arms comprise a monolithic body.

8. The fit adjustment system of claim 7, wherein the monolithic body is formed of a stiffer material than the first and second flexible layers.

9. The fit adjustment system of claim 8, wherein the monolithic body comprises a hinge portion between the dial seat and each of the first and second arms.

10. The fit adjustment system of claim 1, wherein at least the first flexible layer is sufficiently flexible to allow for repeated folding along at least one location above the lower portion.

11. The fit adjustment system of claim 1, wherein at least the first flexible layer has a thickness configured to conform to contouring of a user's head and/or any soft goods worn by the user between the user's head and the helmet.

12. The fit adjustment system of claim 1, further comprising a dial received in the elongate housing and at least one lace, wherein the at least one lace engages the at least one lace guide of the elongate housing and is routed around a perimeter of the helmet cavity, and wherein the dial operatively engages the at least one lace for tightening and loosening of the at least one lace.

13. The fit adjustment system of claim 12, wherein the first flexible layer has a substantially triangular shape defining three vertices, wherein the upper portion includes one of the three vertices, and the lower portion includes the other two of the three vertices.

14. The fit adjustment system of claim 13, wherein the elongate housing is oriented with its length-wise dimension extending between the other two of the three vertices.

15. The fit adjustment system of claim 12, wherein the lace guides position the at least one lace on an outer side of the first flexible layer such that no portion of the at least one lace passes between the first and second flexible layers.

16. The fit adjustment system of claim 1, wherein the lower portion defines a substantially centrally located window through a thickness of the lower portion and wherein the dial seat is exposed to an outer side of the fit adjustment mechanism via the central window.

17. The fit adjustment system of claim 1, wherein the elongate housing comprises a plurality of lace guides spaced apart from one another and the dial seat along a length of a respective one of the first and second arms.

18. The fit adjustment system of claim 1, wherein each of the first and second arms includes at least one protruding structure that provide one or more lace guides.

19. The fit adjustment system of claim 1, wherein the first flexible layer is formed of an elastomer, the upper and lower portions of the first flexible layer being integrally formed, and wherein the elongate housing is formed of a polymer, which when cured is stiffer than the elastomer.

20. The fit adjustment system of claim 1, wherein the second flexible layer is substantially coextensive with both the upper and lower portions of the first flexible layer.

21. The fit adjustment system of claim 1, wherein each of the first and second flexible layers has a thickness not exceeding 3 mm.

22. The fit adjustment system of claim 1, further comprising an attachment member for suspending the first and second flexible layers from the helmet.

23. The fit adjustment system of claim 1 wherein the at least one lace of the helmet comprises a wire.

24. The fit adjustment system of claim 1 wherein the at least one lace of the helmet comprises an elongated member.

25. The fit adjustment system of claim 1, wherein the transverse segment, the first oblique segment, and the second oblique segment define an opening therebetween in the first flexible layer.

26. A fit adjustment system for a helmet defining a helmet cavity, comprising: a flexible member comprising a flexible layer, the flexible layer comprising a transverse segment extending between a first lateral vertex and a second lateral vertex, a first oblique segment, and a second oblique segment, wherein the first oblique segment and the second oblique segment meet at an upper vertex, wherein the first oblique segment meets the transverse segment at the first lateral vertex, and wherein the second oblique segment meets the transverse segment at the second lateral vertex; an attachment member fixed to the flexible member at an attachment location and configured for attaching the flexible member to the helmet; a lace; and a lace tightening assembly attached to and supported by the flexible member and operatively associated with the lace, wherein the lace tightening assembly comprises an elongate housing fixed to the flexible layer, the elongate housing comprising a dial seat configured to accommodate a dial of the lace tightening assembly, the elongate housing further comprising a pair of arms integrally formed with, and extending from opposite sides of, the dial seat, wherein each arm includes one or more lace guides for routing the lace along a length of the flexible member, and wherein the transverse segment, the first oblique segment, and the second oblique segment define an opening therebetween in the flexible layer.

27. The fit adjustment system of claim 26 wherein the flexible member has a substantially triangular shape defining three vertices, wherein an upper portion of the flexible member includes one of the three vertices, and a lower portion of the flexible member includes the other two of the three vertices, wherein the attachment member is attached at the one of the three vertices.

28. The fit adjustment system of claim 27 wherein the elongate housing is oriented with its length-wise dimension extending between the other two of the three vertices.

29. A fit adjustment system for a helmet defining a helmet cavity, comprising: a first flexible layer formed of an elastomer and a second flexible layer joined to the first flexible layer to form a two-layer structure, a lower portion of which extends below a bottom edge of the helmet when the helmet is worn, and wherein the two-layer structure is sufficiently flexible for repeated folding into the helmet's cavity when not worn, the first flexible layer comprising a transverse segment extending between a first lateral vertex and a second lateral vertex, a first oblique segment, and a second oblique segment, wherein the first oblique segment and the second oblique segment meet at an upper vertex, wherein the first oblique segment meets the transverse segment at the first lateral vertex, and wherein the second oblique segment meets the transverse segment at the second lateral vertex; an elongate housing comprising a dial housing fixed between the first and second flexible layers and defining a dial seat which is exposed through a dial opening in the first flexible layer, the elongate housing further comprising first and second arms extending in opposite directions from the dial housing; and a lace-tightening system operatively associated with the dial housing and comprising a dial rotatably coupled to the dial seat and at least one lace engaged with the dial, wherein the lace is routed through at least one pair of left and right lace guides protruding through the first flexible layer, each of the left and right lace guides located on an opposite side of the dial, each of the left and right lace guides included in a respective one of the first arm or the second arm, and wherein the transverse segment, the first oblique segment, and the second oblique segment define an opening therebetween in the first flexible layer.

30. The fit adjustment system of claim 29, wherein the second flexible layer is formed of an elastomer, the system further comprising a fabric liner fixed to the two-layer structure on a side opposite the dial opening.

31. The fit adjustment system of claim 29 further comprising a fabric liner fixed to a user-facing side of the two-layer structure and substantially co-extensive with the two-layer structure.

32. The fit adjustment system of claim 29, wherein the at least one pair of left and right lace guides is integrally formed with the dial housing.

33. The fit adjustment system of claim 29, wherein the first and second flexible layers are joined using hot melt adhesive.

34. The fit adjustment system of claim 29, wherein the dial housing is fixed between the first and second flexible layer as a result of joining of the first and second flexible layers.

* * * * *